US006698239B2

(12) United States Patent
Wueste

(10) Patent No.: US 6,698,239 B2
(45) Date of Patent: Mar. 2, 2004

(54) BRILLIANT CUT DIAMOND

(75) Inventor: Robert J. Wueste, Ocenside, CA (US)

(73) Assignee: Samuel Aaron, Inc., Long Island City, NY (US)

( * ) Notice: Subject to any disclaimer, the term of this patent is extended or adjusted under 35 U.S.C. 154(b) by 0 days.

(21) Appl. No.: 10/083,279

(22) Filed: Feb. 25, 2002

(65) Prior Publication Data

US 2002/0162356 A1 Nov. 7, 2002

Related U.S. Application Data

(60) Provisional application No. 60/271,241, filed on Feb. 23, 2001.

(51) Int. Cl.[7] ..... A44C 17/00

(52) U.S. Cl. ..... 63/32; D11/89; D11/90

(58) Field of Search ..... 63/32; D11/90, D11/89

(56) References Cited

U.S. PATENT DOCUMENTS

| | | | | | |
|---|---|---|---|---|---|
| D35,938 | S | * | 6/1902 | Schenck | D11/90 |
| 2,364,031 | A | | 11/1944 | Suderov | |
| D141,258 | S | * | 5/1945 | Fine | D11/90 |
| 3,286,486 | A | | 11/1966 | Huisman et al. | |
| 3,585,764 | A | | 6/1971 | Huisman et al. | 51/283 |
| 3,763,665 | A | * | 10/1973 | Polakiewicz | 63/32 |
| 3,788,097 | A | | 1/1974 | Elbe | 63/32 |
| 4,306,427 | A | | 12/1981 | Urban | 63/32 |
| 5,186,024 | A | | 2/1993 | Waters, Jr. | 63/32 |
| 5,462,474 | A | | 10/1995 | Hansen | 451/41 |
| 5,612,102 | A | | 3/1997 | Nakama | 428/15 |
| D379,072 | S | * | 5/1997 | Yuan | D11/90 |
| D379,073 | S | * | 5/1997 | Yuan | D11/90 |
| 5,657,647 | A | | 8/1997 | Freiesleben | 63/32 |
| D414,133 | S | | 9/1999 | Parker | D11/90 |
| 6,305,193 | B1 | * | 10/2001 | Cheng | 63/32 |
| D453,120 | S | * | 1/2002 | Cheng | D11/90 |
| D460,713 | S | * | 7/2002 | Cohen | D11/90 |
| D469,033 | S | * | 1/2003 | Siebenberg | D11/90 |

OTHER PUBLICATIONS

Unique Designs, Fine Designer Jewelry & Art Glass, "144 Facet Diamond", World's Most Brilliant Diamond.

Buying Basics, "Revolutionary New Diamond Cuts Add Spice to Engagement Rings".

* cited by examiner

*Primary Examiner*—J. J. Swann
*Assistant Examiner*—Thomas Ho
(74) *Attorney, Agent, or Firm*—Cohen, Pontani, Lieberman & Pavane

(57) ABSTRACT

A brilliant-cut gemstone having a pavilion, girdle, and crown is disclosed. The pavilion of the gemstone has 56 facets: specifically, 8 lower diamond-shaped facets, 16 middle kite-shaped facets, and 32 upper triangular facets. The girdle and table may be formed of one or more facets. In one preferred embodiment, the total number of crown facets (excluding the table) is 56, making a total of 114 facets (including the table). In another preferred embodiment, the total number of crown facets (excluding the table) is 64, making a total of 122 facets (including the table).

12 Claims, 5 Drawing Sheets

FIG. 4A
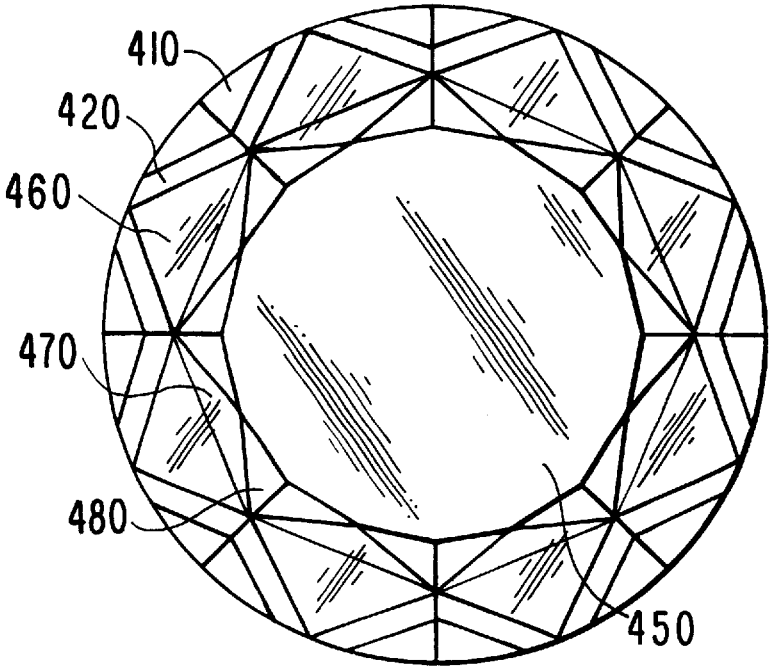
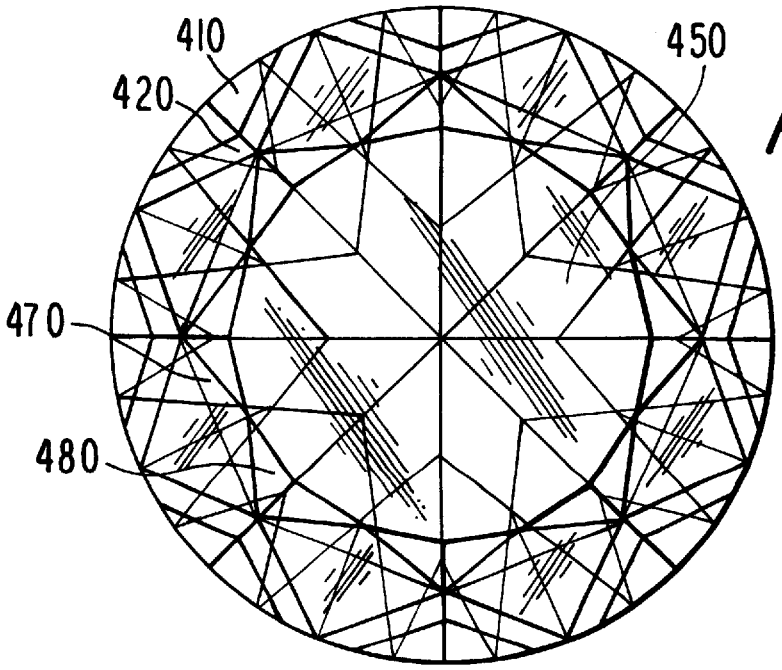
FIG. 4B

BRILLIANT CUT DIAMOND

RELATED APPLICATIONS

This application claims priority from U.S. Provisional Patent Application Serial No. 60/271,241 entitled "Multi-faceted Stone" which was filed on Feb. 23, 2001.

BACKGROUND OF THE INVENTION

1. Field of the Invention

This invention relates generally to faceted gemstone construction and, specifically, to the faceted construction of a brilliant-cut diamond to provide improved luster and appearance.

2. Description of the Related Art

Because the present invention is primarily concerned with a brilliant-cut diamond (although the present invention may be applied to other gemstones), the discussion that follows will focus on brilliant-cut diamonds. The round brilliant cut sets the standard for all other diamond shapes, and accounts for more than 75% of diamonds sold today.

As shown in the prior art diamond profile of FIG. 1, there are three basic sections to a brilliant-cut diamond: the crown 110, the girdle 120, and the pavilion 130. The girdle 120 is the narrow rim of the gemstone that separates the crown 110 from the pavilion 130. It is the section with the largest diameter of any part of the stone. Usually it is left in an unpolished state with a matte finish. However, to achieve more overall brilliance (described below), girdle 120 is often ground. Crown 110 and pavilion 130 can be understood as the "top" and "bottom", respectively, of the brilliant-cut diamond. The tiny facet on the pointed bottom of pavilion 130 is the culet 135. The large, flat top facet of crown 110 is the table 115.

For a cut diamond, a feature of primary importance is its brilliance, which is essentially how much it shines. A diamond has a refractive index of 2.42, which is a very high value compared with that of other jewels (the index of crystal is 1.55; rubies and sapphires, 1.77). As a result, when rays of light incident on table 115 reach pavilion 130, most of the rays are reflected totally (i.e., the rays of light do not escape the diamond through pavilion 130, but are reflected inward again), and escape upon reaching crown 110, thereby reaching the observer's eyes as brilliance. The angle 137 of pavilion 130 is important to total reflection, and thusly is important to the brilliance of a diamond.

The refractive index of the diamond also gives rise to the dispersion of the totally reflected rays of light into the seven colors of the visible light spectrum. This rainbow effect is sometimes called the fire of the stone. Scintillation is the glittering of the reflected light of a diamond caused by the movement of either the observer or the diamond itself. Scintillation depends primarily on the size of the diamond, the number of facets, the polish of the facets, and the accuracy of the angles of the respective facets.

Diamonds are commonly assessed in terms of the "4 Cs": Cut, Clarity, Color, and Carat. Cut refers to both the geometric proportions of a gemstone and the final form into which the rough stone is shaped. The most prominent cuts in the industry are the round brilliant, oval, marquise, pear, heart, emerald, princess, trilliant, and radiant. A good cut gives a diamond its brilliance, dispersion, and scintillation, in short, its appearance and appeal. Clarity is the measure by which a diamond is graded for purity, or whiteness. This is done by taking in the presence or absence of blemishes on the diamond's surface, or inclusions within the diamond.

The professional grading scale is: flawless (F); internally flawless (IF); very, very slightly included (VV); very slightly included (VS); slightly included (SI); imperfect (I).

Color refers to the system of grading diamonds on the quality of their tint, from colorless to a pronounced yellow hue. Modern methods use letters to designate differences in colors. They are D–F, for colorless; G–J, for nearly colorless; K–M, for faintly yellow; N–R, for very light yellow; S–X, for light yellow; Y–Z, for yellow. The traditional method ascribes names to the variations in tint: pure white (extra river; river), top-white (wesselton), off-white (silver cape, tope cape, cape, dark cape), yellow, and brown. Carat is the unit of weight (equal to 200 milligrams) by which a diamond or other gemstone is measured. The word is derived from the carob bean, whose consistent weight was historically used to measure gemstones.

The present invention is primarily directed to the brilliant-cut diamond. The round brilliant-cut diamond is characterized by many facets of different shapes and sizes. This maximizes a diamond's brilliance by minimizing the amount of light that can escape through pavilion 130, as well as maximizing the scintillation effect of the crown by increasing and varying the reflective surfaces. The typical brilliant cut has 58 total facets and may fit the "Ideal Cut", a range of proportions and angles that are maintained as a standard by the American Gem Society.

The origin of the number of facets (i.e., 58) found in a typical brilliant-cut diamond, and of the "Ideal Cut" standard may be found in the history of gemstone cutting. The art of cutting and polishing gemstones is very old, but a unified science and theory of facet proportion is relatively recent. Before the 1900's, the predecessors of the round brilliant-cut diamond, such as the European or Old Mine cut, varied widely in appearance. Because of the limitations of technology, these diamonds had very small tables, large culets, and short pavilion facets; but there was no single widely-recognized or agreed-upon standard of cutting them.

In 1919, diamond cutter Marcel Tolkowsky wrote a doctoral dissertation that essentially established the modern standard of a brilliant-cut diamond. Using only his own visual assessments of different variations of diamond cuts, Tolkowsky posited a theory of what cutting angles would produce the most proportionate balance of brilliance, scintillation, and dispersion in a gem-quality diamond. His measurements for achieving this balance were exact and strict. Fortuitously, improved cutting techniques and technology were being developed at the same time that finally allowed cutters to achieve more precise and stream-lined designs. Since that time, Tolkowsky's measurements have evolved into the looser "Ideal Cut" standard promulgated by the American Gem Society (AGS).

However, over time, other diamond cutters have found ways to increase the brilliance of the brilliant-cut diamond by exceeding the typical 58 facets. For example, Huisman et al. (U.S. Pat. No. 3,286,486) took the "conventional twenty-four facets" of the brilliant-cut diamond and tripled them to create a pavilion with seventy-two facets. The greatly increased number of facets in the pavilion and the different angles at which a great many of them are cut result in enhanced brilliance. Nevertheless, Huisman et al. left the girdle and crown to be "of any conventional size". A later patent by the same inventors increased the number of facets of the girdle (Huisman et al. (U.S. Pat. No. 3,585,764)).

Other diamond cutters concentrated on other features besides brilliance. For example, Freiesleben (U.S. Pat. No. 5,657,647) reduces the number of crown facets in order to create large planar surfaces on the top of the diamond in order to "create an impression of calm and hardness". One diamond cutter sought to create greater dispersion (and the capability of highlighting colors) by etching fine grooves (0.1 μm to 1,000 μm) into the planar surfaces of the facets (Nakama (U.S. Pat. No. 5,612,102)). Another diamond cutter sought greater scintillation by making the number of mid-level pavilion facets an odd number rather than the standard even number of facets (Elbe (U.S. Pat. No. 3,788,097).

Although these attempts have met with varying degrees of success, there is always the need for a new brilliant cut which uniquely maximizes and balances the features of brilliance, dispersion, and scintillation of a diamond. Furthermore, there is the need for a brilliant cut with an increased number of facets (in comparison to the typical brilliant cut) in order to increase the brilliance, dispersion, and scintillation of the diamond.

SUMMARY OF THE INVENTION

One object of the present invention is to provide a new and unique brilliant cut gemstone which maximizes and balances the features of brilliance, dispersion, and scintillation of a gemstone.

Another object of the present invention is to provide a brilliant cut gemstone with an increased number of facets (in comparison to the typical brilliant cut) in order to increase the brilliance, dispersion, and scintillation of the gemstone.

These and other objects are achieved by a brilliant-cut gemstone according to the present invention. The novel brilliant-cut gemstone comprises a crown, a girdle, and a pavilion. The pavilion has 56 facets. These 56 pavilion facets comprise 8 lower substantially diamond-shaped pavilion facets, 16 middle substantially kite-shaped pavilion facets, and 32 upper substantially triangular shaped pavilion facets.

In one aspect of the invention, the brilliant-cut gemstone has 114 facets. In this aspect, the crown comprises 16 lower triangular crown facets, 16 lower rhomboidal crown facets, 8 middle kite-shaped crown facets, and 16 upper triangular crown facets.

In another aspect of the invention, the brilliant-cut gemstone has 122 facets. In this aspect, the crown comprises 16 lower triangular crown facets, 16 lower rhomboidal crown facets, 8 middle triangular crown facets, 8 first upper triangular crown facets, and 16 second upper triangular crown facets.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings:

FIG. 3B shows the facets (in lighter lines) of the pavilion on the bottom of the brilliant-cut diamond;

FIGS. 4A and 4B are top views of the crown of a brilliant-cut diamond according to another preferred embodiment of the present invention, where FIG. 4B shows the facets (in lighter lines) of the pavilion on the bottom of the brilliant-cut diamond.

DETAILED DESCRIPTION OF THE PRESENTLY PREFERRED EMBODIMENTS

The present invention comprises new and unique combinations of pavilion, girdle, and crown facets which provide a unique balance of brilliance, scintillation, and dispersion. In these unique combinations, the number of facets is greatly increased from the typical number of facets, thereby increasing the brilliance, dispersion, and scintillation of the diamond. Thus, diamonds with inferior clarity and/or color may be cut in such a manner as to conceal the inferior clarity and/or color through the heightened brilliance and scintillation caused by the present invention.

There are two preferred embodiments of the present invention: the 114 facet diamond and the 122 facet diamond. Both diamond cuts have the same number and configuration of pavilion facets, but a different number of crown facets.

Figure 1:
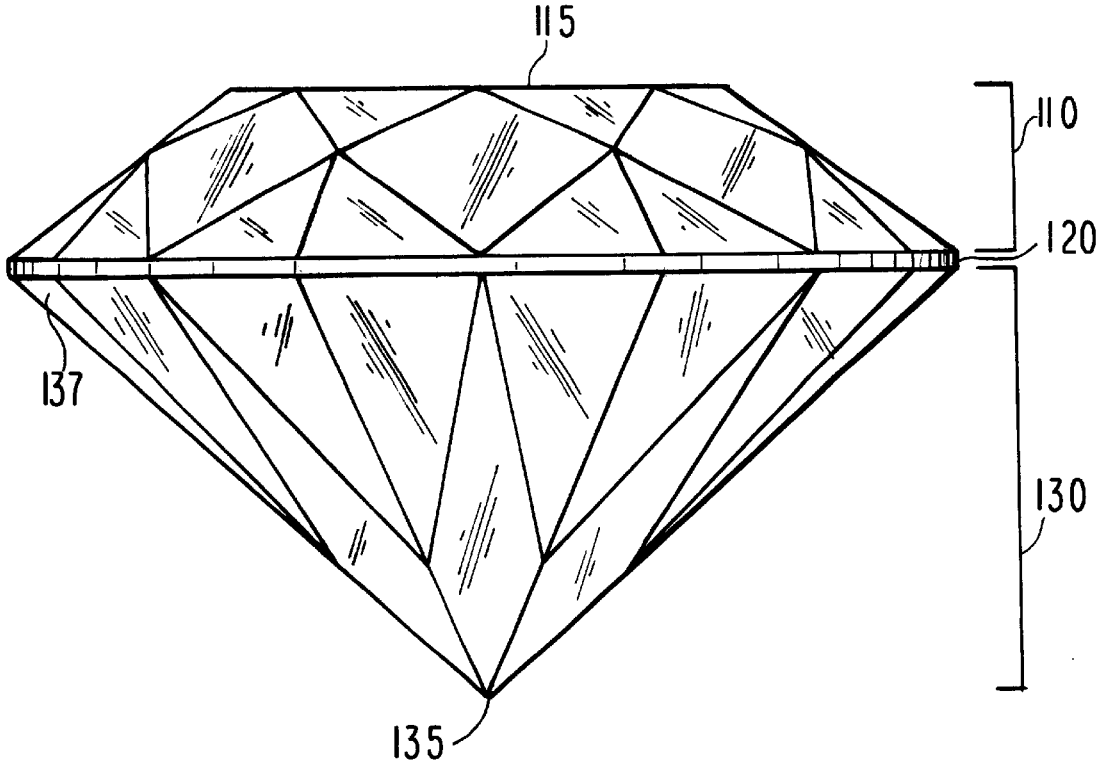
FIG. 1 (PRIOR ART)
FIG. 1 depicts a profile of a prior art brilliant-cut diamond.
Figure 2A:
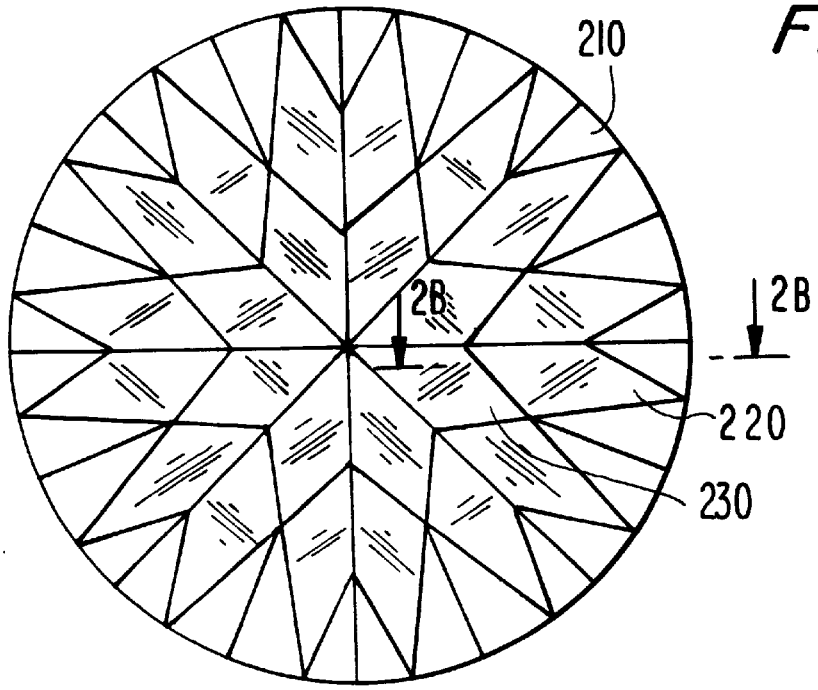
FIG. 2A is the bottom view of the pavilion of a brilliant-cut diamond according to a preferred embodiment of the present invention.
Figure 2B:
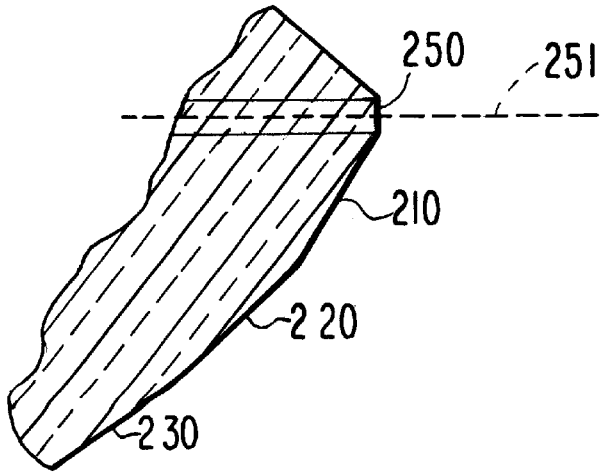
FIG. 2B is the partial profile of the cross-section (taken at line 2B in FIG. 2A) of the pavilion of a brilliant-cut diamond according to a preferred embodiment of the present invention.

FIGS. 2A and 2B show the construction of the pavilion shared by both preferred embodiments. FIG. 2A is the view of the pavilion from the bottom and FIG. 2B is a partial profile of the cross-section taken at line 2B in FIG. 2A, focussing on the pavilion (and girdle). The pavilion has a total of 56 facets. There are 32 upper substantially triangular pavilion facets 210 (located directly under the girdle), 16 middle substantially kite-shaped pavilion facets 220, and 8 lower substantially diamond-shaped pavilion facets 230. These facets can be further described by the angle each of their flat planar surfaces form with a plane parallel to the horizontal plane 251 of girdle 250. These angles are listed in Table 1.

TABLE 1

| Pavilion Facets | | | |
|---|---|---|---|
| Facet | Shape | Amount | Angle |
| Lower Pavilion | Diamond | 8 | 40°–43° |
| Middle Pavilion | Kite | 16 | 42°–45° |
| Upper Pavilion | Triangle | 32 | 43°–46° |

Figure 3A:
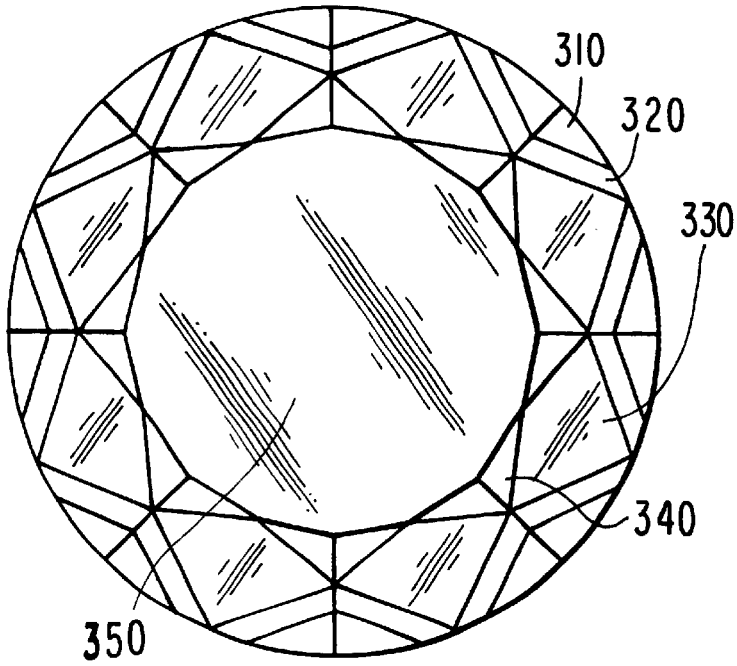
FIGS. 3A and 3B are top views of the crown of a brilliant-cut diamond according to one preferred embodiment of the present invention, where
Figure 3B:
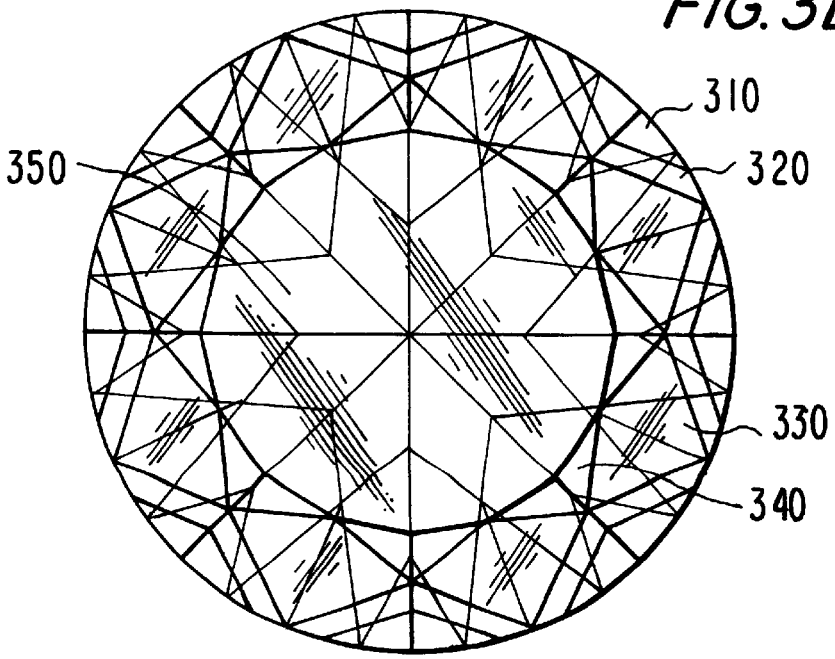
Figure 3C:
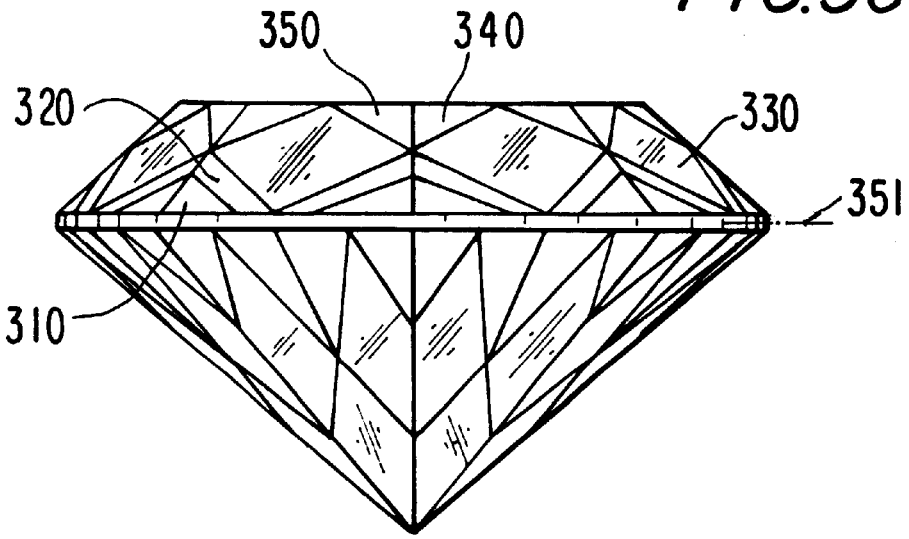
FIG. 3C is a side view of the brilliant-cut diamond according to the preferred embodiment in FIGS. 3A and 3B.

FIGS. 3A and 3B are the same top view of the crown of the 114 faceted preferred embodiment. In FIG. 3B, the facets (in lighter lines) of the pavilion on the bottom of the diamond can be seen through top surface of the crown. The crown has a total of 57 facets. Although this preferred embodiment has a girdle of only one facet, other embodiments may have girdles with multiple facets. In FIGS. 3A and 3B, there are 16 lower substantially triangular crown facets 310 (located directly above the girdle), 16 lower substantially rhomboidal crown facets 320, 8 middle substantially kite shaped crown facets 330, and 16 upper substantially triangular crown facets 340. In addition, there is one table facet 350 comprised of a 16-sided polygon. FIG. 3C is a side view of the 114 facet embodiment, showing the side of the pavilion, girdle, and crown. All of the crown facets can be further described by the angle each of their flat planar surfaces form with a plane parallel to the horizontal plane 361 of girdle 360 in FIG. 3C. These angles are listed in Table 2.

TABLE 2

Crown Facets of the 114 Facet Brilliant Cut

| Facet | Shape | Amount | Angle |
|---|---|---|---|
| Lower Triangular Crown | Triangle | 16 | 35°–38° |
| Lower Rhomboidal Crown | Rhomboid | 16 | 33.5°–36.5° |
| Middle Crown | Kite | 8 | 32°–35° |
| Upper Crown | Triangle | 16 | 29°–32° |
| Table | 16-sided polygon | 1 | 0° |

Figure 4C:
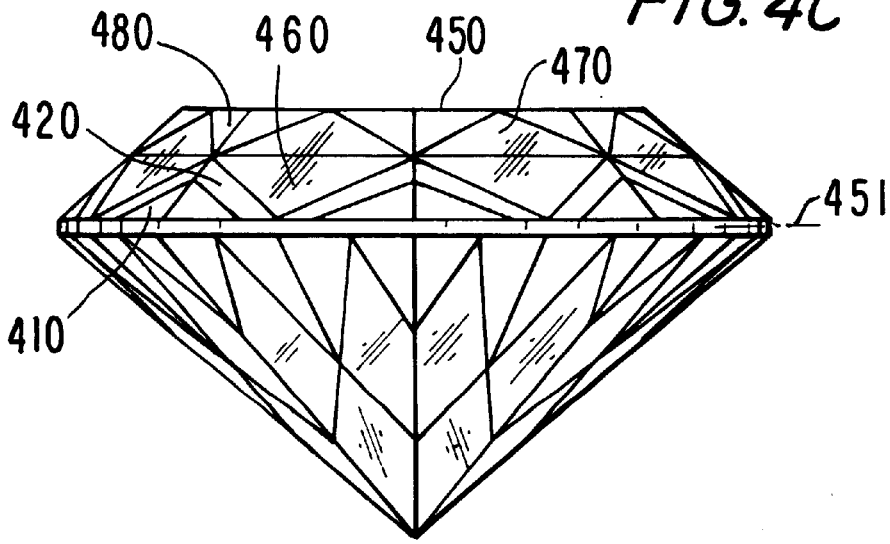
FIG. 4C is a side view of the brilliant-cut diamond according to the preferred embodiment in FIGS. 4A and 4B.

FIGS. 4A and 4B are the same top view of the crown of the 122 faceted preferred embodiment. In FIG. 4B, the facets (in lighter lines) of the bottom of the diamond can be seen through the crown. The crown has a total of 65 facets. Although this preferred embodiment has a girdle of only one facet, other embodiments may have girdles with multiple facets. In FIGS. 4A and 4B, there are 16 lower substantially triangular crown facets 410 (right above the girdle), 16 lower substantially rhomboidal crown facets 420, 8 middle substantially triangular crown facets 460, 8 first upper substantially triangular crown facets 470, and 16 second upper substantially triangular crown facets 480. In addition, there is one table facet 450 comprised of a 16-sided polygon. FIG. 4C is a side view of the 122 facet embodiment, showing the side of the pavilion, girdle, and crown. As in the above-described embodiment, the orientation or arrangement of the crown facets can be further described by the angles each facet planar surface forms with the horizontal plane 451 of girdle 450 in FIG. 4C. These angles are listed in Table 3.

TABLE 3

Crown Facets of the 122 Facet Brilliant Cut

| Facet | Shape | Amount | Angle |
|---|---|---|---|
| Lower Triangular Crown | Triangle | 16 | 39°–42° |

TABLE 3-continued

Crown Facets of the 122 Facet Brilliant Cut

| Facet | Shape | Amount | Angle |
|---|---|---|---|
| Lower Rhomboidal Crown | Rhomboid | 16 | 37°–38° |
| Middle Crown | Triangle | 8 | 32°–35° |
| First Upper Crown | Triangle | 8 | 30°–33° |
| Second Upper Crown | Triangle | 16 | 24°–26° |
| Table | 16-sided polygon | 1 | 0° |

In summary, although the two preferred embodiments have a particular number of facets, there is the possibility of variation, as would be known by one skilled in the art. For example, as shown in Table 4, which summarizes the facets of the two preferred embodiments, there is some flexibility in the cutting of the girdle, thereby allowing other embodiments of the present invention to exceed 114 or 122 facets depending on the resulting number of facets in the girdle.

TABLE 4

Total Possible Facets of the Preferred Embodiments

| | Facet | Amount | | Facet | Amount |
|---|---|---|---|---|---|
| "114 Facet" Cut | Crown (includ. Table) | 56 (+1) | "122 Facet" Cut | Crown (includ. Table) | 64 (+1) |
| | Girdle | 1 or more | | Girdle | 1 or more |
| | Pavilion | 56 | | Pavilion | 56 |
| | Total: | 114+ | | Total: | 122+ |

As evidenced by the two preferred embodiments discussed above and illustrated in FIGS. 2A through 4C and Tables 1 through 4, the construction of the present invention has numerous advantages over the prior art. Greater scintillation is caused by the greater number of facets, both in the pavilion and crown, than the typical brilliant-cut diamond, and the different angles and sizes of the facets. Greater brilliance results from the greater number of facets in the pavilion than the typical brilliant-cut diamond, as well as the unique and different angles and sizes of the facets. A unique appearance is created by the unique balance of brilliance, scintillation, and dispersion caused by the inventive and novel construction. In addition, the unique angles and sizes of the facets combine to achieve a more flowing design.

Furthermore, because of the increased brilliance and scintillation, the present inventive cut may be used on diamonds with inferior clarity and/or color in order to heighten their appearance and luster and to hide their imperfections. For example, the present invention may be used to conceal inclusions or carbon spots inside an inferior diamond, thereby increasing its demand and hence, its worth.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A brilliant-cut gemstone comprising:

a crown comprising;

16 lower substantially triangular crown facets, each one having a first edge positioned adjacent to the girdle, a second edge positioned adjacent to a neighboring lower triangular crown facet and a third edge;

16 lower substantially rhomboidal crown facets, each one having a first edge positioned adjacent to the girdle, a second edge opposite to the first edge and positioned adjacent to a neighboring lower rhomboidal facet, and a third edge positioned adjacent to the third edge of a neighboring one of the 16 lower triangular crown facets;

8 middle substantially kite-shaped crown facets, each one having a first edge positioned adjacent to a first neighboring lower rhomboidal facet and a second edge contiguous with the first edge, said second edge positioned adjacent to a second neighboring lower rhomboidal facet; and 16 upper substantially triangular crown facets, each one having a first edge positioned adjacent to a neighboring one of the 8 middle kite-shaped frown facets and a second edge positioned adjacent to a neighboring one of the upper triangular crown facets;

a girdle; and a pavilion having 56 facets with 8 lower substantially diamond-shaped pavilion facets oriented so that each one tapers to a pointed bottom of the pavilion, 16 middle substantially kite-shaped pavilion facets oriented so that each one is positioned adjacent to a neighboring one of the 8 lower pavilion facets at a lower edge thereof and having an upper point touching the girdle, and 32 upper substantially triangular pavilion facets, each having two sides substantially equal in length, and a third side, each substantially triangular pavilion facet being positioned so that one equal side is adjacent to a neighboring upper pavilion facet, the other equal side is positioned adjacent to a neighboring one of the 16 middle pavilion facets, and the third side is positioned adjacent to the girdle.

2. The gemstone as recited in claim 1, wherein:

each of the 8 lower substantially diamond-shaped pavilion facets has a planar face which forms an angle in a range of about 40°–43° with a horizontal plane of the girdle;

each of the 16 middle substantially kite-shaped pavilion facets has a planar face which forms an angle in a range of about 42°–45° with the horizontal plane of the girdle; and each of the 32 upper substantially triangular pavilion facets has a planar face which forms an angle in a range of about 43°–46° with the horizontal plane of the girdle.

3. The gemstone as recited in claim 1, wherein the crown further comprises:

a table defined by 16 edges with each said edge forming a side of a respective one of the 16 upper triangular crown facets.

4. The gemstone as recited in claim 1 wherein:

each of the 16 lower substantially triangular crown facets has a planar face which forms an angle in a range of about 35°–38° with a horizontal plane of the girdle;

each of the 16 lower substantially rhomboidal crown facets has a planar face which forms an angle in a range of about 33.5°–36.5° with the horizontal plane of the girdle;

each of the 8 middle substantially kite-shaped crown facets has a planar face which forms an angle in a range of about 32°–35° with the horizontal plane of the girdle; and each of the 16 upper substantially triangular crown facets has a planar face which forms an angle in a range of about 29°–32° with the horizontal plane of the girdle.

5. The gemstone as recited in claim 1, wherein the brilliant-cut gemstone is a diamond.

6. A brilliant-cut gemstone comprising:

a crown comprising;

16 lower substantially triangular crown facets, each one having a first edge positioned adjacent to the girdle, a second edge positioned adjacent to a neighboring lower triangular crown facet and a third edge;

16 lower substantially rhomboidal crown facets, each one having a first edge positioned adjacent to the girdle, a second edge opposite to the first edge and positioned adjacent to a neighboring lower rhomboidal facet, and a third edge positioned adjacent to the third edge of a neighboring one of the 16 lower triangular crown facets;

8 middle substantially triangular crown facets, each one having a first edge positioned adjacent to a first neighboring lower rhomboidal facet and a second edge contiguous with the first edge, said second edge positioned adjacent to a second neighboring lower rhomboidal facet;

8 first upper substantially triangular crown facets, each one having a first edge positioned adjacent to a neighboring one of the 8 middle triangular crown facets; and 16 second upper substantially triangular crown facets, each one having a first edge positioned adjacent to a neighboring one of the 8 first upper triangular crown facets and a second edge positioned adjacent to a neighboring one of the second upper triangular crown facets;

a girdle; and a pavilion having 56 facets with 8 lower substantially diamond-shaped pavilion facets oriented so that each one tapers to a pointed bottom of the pavilion, 16 middle substantially kite-shaped pavilion facets oriented so that each one is positioned adjacent to a neighboring one of the 8 lower pavilion facets at a lower edge thereof and having an upper point touching the girdle, and 32 upper substantially triangular pavilion facets, each having two sides substantially equal in length, and a third side, each substantially triangular pavilion facet being positioned so that one equal side is adjacent to a neighboring upper pavilion facet, the other equal side is positioned adjacent to a neighboring one of the 16 middle pavilion facets, and the third side is positioned adjacent to the girdle.

7. The gemstone as recited in claim 6, wherein the crown further comprises:

a table defined by 16 edges with each said edge forming a side of a respective one of the 16 upper triangular crown facets.

8. The gemstone as recited in claim 6, wherein:

each of the 16 lower substantially triangular crown facets has a planar face which forms an angle in a range of about 39°–42° with a horizontal plane of the girdle;

each of the 16 lower substantially rhomboidal crown facets has a planar face which forms an angle in a range of about 37°–38° with the horizontal plane of the girdle;

each of the 8 middle substantially triangular crown facets has a planar face which forms an angle in a range of about 32°–35° with the horizontal plane of the girdle;

each of the 8 first upper substantially triangular crown facets has a planar face which forms an angle in a range of about 30°–33° with the horizontal plane of the girdle; and each of the 16 second upper substantially triangular crown facets has a planar face which forms an angle in a range of about 24°–46° with the horizontal plane of the girdle.

9. A brilliant-cut gemstone comprising:

a girdle;

a crown having 16 lower substantially triangular crown facets, each one having a first edge positioned adjacent to the girdle, a second edge positioned adjacent to a neighboring lower triangular crown facet, and a third edge, 16 lower substantially rhomboidal crown facets, each one having a first edge positioned adjacent to the girdle, a second edge opposite to the first edge and positioned adjacent to a neighboring lower rhomboidal facet, and a third edge positioned adjacent to the third edge of a neighboring one of the 16 lower triangular crown facets, 8 middle substantially kite-shaped crown facets, each one having a first edge positioned adjacent to a first neighboring lower rhomboidal facet and a second edge contiguous with the first edge, said second edge positioned adjacent to a second neighboring lower rhomboidal facet, and 16 upper substantially triangular crown facets, each one having a first edge positioned adjacent to a neighboring one of the 8 middle kite-shaped crown facets and a second edge positioned adjacent to a neighboring one of the upper triangular crown facets; and a pavilion having 56 facets with 8 lower substantially diamond-shaped pavilion facets oriented so that each one tapers to a pointed bottom of the pavilion, 16 middle substantially kite-shaped pavilion facets, oriented so that each one is positioned adjacent to a neighboring one of the 8 lower pavilion facets at a lower edge thereof and having an upper point touching the girdle, and 32 upper substantially triangular pavilion facets, each having two sides substantially equal in length, and a third side, each substantially triangular pavilion facet being positioned so that one equal side is adjacent to a neighboring upper pavilion facet, the other equal side is positioned adjacent to a neighboring one of the 16 middle pavilion facets, and the third side is positioned adjacent to the girdle.

10. The gemstone as recited in claim 9, wherein the gemstone has a total of 114 facets with the girdle comprising one facet and the crown further comprising a table of one facet.

11. The gemstone as recited in claim 9, wherein the gemstone has a total of 122 facets with the girdle comprising one facet and the crown further comprising a table of one facet.

12. A brilliant-cut gemstone comprising:

a girdle;

a crown having 16 lower substantially triangular crown facets, each one having a first edge positioned adjacent to the girdle, a second edge positioned adjacent to a neighboring lower triangular crown facet, and a third edge, 16 lower substantially rhomboidal crown facets, each one having a first edge positioned adjacent to the girdle, a second edge opposite to the first edge and positioned adjacent to a neighboring lower rhomboidal facet, and a third edge positioned adjacent to the third edge of a neighboring one of the 16 lower triangular crown facets, 8 middle substantially triangular crown facets, each one having a first edge positioned adjacent to a first neighboring lower rhomboidal facet and a second edge contiguous with the first edge, said second edge positioned adjacent to a second neighboring lower rhomboidal facet, 8 first upper substantially triangular crown facets, each one having a first edge positioned adjacent to one of the 8 middle triangular crown facets, and 16 second upper substantially triangular crown facets, each one having a first edge positioned adjacent to a neighboring one of the 8 first upper triangular crown facets and a second edge positioned adjacent to a neighboring one of the second upper triangular crown facet; and a pavilion having 56 facets with 8 lower substantially diamond-shaped pavilion facets oriented so that each one tapers to a pointed bottom of the pavilion, 16 middle substantially kite-shaped pavilion facets oriented so that each one is positioned adjacent to a neighboring one of the 8 lower pavilion facets at a lower edge thereof and having an upper point touching the girdle, and 32 upper substantially triangular pavilion facets, each having two sides substantially equal in length, and a third side, each substantially triangular pavilion facet being positioned so that one equal side is adjacent to a neighboring upper pavilion facet, the other equal side is positioned adjacent to a neighboring one of the 16 middle pavilion facets, and the third side is positioned adjacent to the girdle.

* * * * *